US005736812A

United States Patent [19]

Park et al.

[11] Patent Number: 5,736,812

[45] Date of Patent: Apr. 7, 1998

[54] ELECTRON GUNS FOR COLOR PICTURE TUBE

[75] Inventors: Myung Ho Park, Kyungsangbook-Do; Soo Keun Lee, Seoul, both of Rep. of Korea

[73] Assignee: Goldstar Co., LTD., Seoul, Rep. of Korea

[21] Appl. No.: 890,283

[22] Filed: Jul. 9, 1997

Related U.S. Application Data

[63] Continuation of Ser. No. 711,063, Sep. 9, 1996, abandoned, which is a continuation of Ser. No. 349,445, Dec. 5, 1994, abandoned.

[30] Foreign Application Priority Data

Dec. 7, 1993 [KR] Rep. of Korea ..... 26733/1993

[51] Int. Cl.[6] ..... H01J 29/58

[52] U.S. Cl. ..... 313/413; 313/414; 313/449

[58] Field of Search ..... 313/412, 413, 313/414, 449

[56] References Cited

U.S. PATENT DOCUMENTS 4,704,565 11/1987 Blacker, Jr. et al. ..... 315/382

4,772,827 9/1988 Osakabe ..... 313/414

4,877,998 10/1989 Maninger et al. ..... 313/414

5,281,892 1/1994 Kweon et al. ..... 313/414

*Primary Examiner*—Nimeshkumar Patel

*Attorney, Agent, or Firm*—Ostrolenk, Faber, Gerb & Soffen, LLP

[57] ABSTRACT

Electron guns for color picture tube capable of strengthening the refracting action of electrostatic prisms and of overcoming possible distortion of three electron beams at about the periphery of a screen due to strong nonuniform magnetic field are disclosed. The electron guns has variable asymmetric electrostatic lenses, which lenses include first and second focusing electrodes, a first electrostatic deflection electrode mounted to the first focusing electrode, a second electrostatic deflection electrode mounted to the second focusing electrode, and an accelerating electrode placed in front of the second focusing electrode. In another embodiment, the variable asymmetric electrostatic lenses of the electron guns includes electrostatic deflection means placed between the first and second focusing electrodes.

3 Claims, 8 Drawing Sheets

ELECTRON GUNS FOR COLOR PICTURE TUBE

This is a Continuation of application Ser. No. 08/711,063, filed on Sep. 9, 1996, now abandoned, which is a Continuation of application Ser. No. 08/349,445, filed Dec. 5, 1994, now abandoned.

BACKGROUND OF THE INVENTION

1. Field of the Invention

The present invention relates in general to in-line electron guns for color picture tubes and, more particularly, to a structural improvement in such electron guns for overcoming severe distortion of electron beams at the phosphor screen of the color picture tube due to a strong nonuniform magnetic field, and for improving picture quality of the color picture tube.

2. Description of the Prior Art

Recently, the need has increased to achieve high resolution as well as to improve electron beam focus characteristics at the center portion of a phosphor screen of the color picture tube as well as at about corners of the phosphor screen. In this regard, the electron beam focus characteristics at about the corners of the phosphor screen need to be improved beyond achieved characteristics.

With reference to FIG. 1, there is shown a typical in-line color picture tube. As shown in this drawing, the in-line color picture tube 1 has in-line guns 4, which in-line guns 4 include three electron guns arranged in a horizontal line in a neck 3 of the tube 1 to emit three electron beams. Hereinbelow, the in-line guns will be referred to the three electron guns or the electron guns. The three electron guns 4 emit the three electron beams 6R, 6G and 6B to a phosphor screen 2, which screen 2 is applied with three color phosphors, that is, red, green and blue color phosphors, in the form of vertical stripes on its surface. In addition, a deflection yoke 5 having deflection magnetic fields for deflecting the three electron beams 6R, 6G and 6B is placed around the neck 3 of the color picture tube 1.

Representative example of such electron guns 4 is shown in an enlarged view of FIG. 2. As shown in this drawing, the electron guns 4 include three electron beam sources or three cathodes 7, 8 and 9 that emit their respective electron beams or R, G and B beams 6R, 6G and 6B. The cathodes 7, 8 and 9 and their heaters are placed in the horizontal line and spaced out at regular intervals. The three axes of the cathodes 7, 8 and 9 are aligned with the centers of associated openings of two grids, that is, first and second grids 10 and 11, which grids 10 and 11 are parallel to each other. The two grids 10 and 11, which are plate type electrodes, are spaced apart from the cathodes 7, 8 and 9 at predetermined intervals. In the electron guns 4, the cathodes 7, 8 and 9 and the first and second grids 10 and 11 form main lenses.

The electron guns 4 also include a focusing electrode 12 and an accelerating electrode 14, which electrodes 12 and 14 are placed in front of the main lenses. The central axes of openings of the focusing electrode 12 are aligned with the centers of their associated openings (not shown) of the cathodes 7, 8 and 9. In addition, the focusing electrode 12 and the accelerating electrode 14 are arranged in a common plane and parallel to each other. The electron guns 4 further include a hollow cylindrical shield cup 16 in front of the accelerating electrode 14. This shield cup 16 shields and weakens the leaked magnetic fields of the deflection yoke 5.

In operation of the above electron guns 4, the electron beam sources or the cathodes 7, 8 and 9 emit their electron beams 6R, 6G and 6B. The three electron beams 6R, 6G and 6B pass through the first grid 10 and the second grid 11 in turn and, thereafter, are focused on the phosphor screen 2 by an electrostatic focusing lens, which electrostatic focusing lens is formed due to difference of voltage between the focusing electrode 12 and the accelerating electrode 14. In the electron guns 4, the electron beams 6R, 6G and 6B emitted from the cathodes 7, 8 and 9 pass while keeping parallelism and a separation interval D. In this case, the two side beams 6R and 6B of the three electron beams 6R, 6G and 6B are converged into the center beam 6B due to the eccentricity "e" of the central axes of the side openings **14*b* and 14*c* of the accelerating electrode 14 from the central axes of the side openings 12*b* and 12*c* of the focusing electrode 12. Such a convergence for converging the side beams 6R and 6B into the center beam 6G and for focusing the three beams 6R, 6G and 6B on the screen 2 is referred to as the static convergence of the electron guns 4. The static convergence carries out color control about the center portion of the screen 2**.

However, when the three electron beams 6R, 6G and 6B are deflected to the periphery of the screen 2 by the deflection yoke 4 as shown in FIG. 3, the optical paths of the three electron beams 6R, 6G and 6B are lengthened, so that the focussing lengths of the three beams 6R, 6G and 6B, which are controlled to focus the beams on the same points at the center of the screen 2 (due to the static convergence of the electron guns 4), fail to do so at the periphery of the screen 2.

In order to compensate for the deviation of the focuses of the three beams 6R, 6G and 6B from each other at the periphery of the screen 2, the side beams 6R and 6B need to be magnetically converged into the center beam 6G on the screen 2 by the action of the magnetic field of the deflection yoke 5. In order to achieve the above object, the horizontal deflection magnetic field of the yoke 5 is a pincushion distortion magnetic field as shown in FIG. 4A, while the vertical deflection magnetic field of the yoke 5 is a barrel distortion magnetic field as shown in FIG. 4B. The above deflection yoke is called a self-convergence deflection yoke.

Meanwhile, the magnetic field of the above self-convergence deflection yoke deflects the electron beams 6R, 6G and 6B and, at the same time, not only diverge the beams 6R, 6G and 6B in the horizontal direction but also converge the beams 6R, 6G and 6B in the vertical direction. Therefore, the electron beams 6R, 6G and 6B are affected by astigmatism at about the periphery of the screen 2, thus deteriorating the picture quality of the color picture tube.

That is, the astigmatism which affects the electron beams 6R, 6G and 6B at about the periphery of the screen 2 is caused by the nonuniform magnetic field generated by the self-convergence deflection yoke. In order to remove the astigmatism, it is preferred to use either a deflection yoke generating a uniform magnetic field or a deflection yoke generating a weak nonuniform magnetic field. When compensating the electron guns for the above deviation of the focuses of the three beams 6R, 6G and 6B, the astigmatism which will affect the electron beams 6R, 6G and 6B at about the periphery of the screen 2 will be somewhat reduced. However, such compensation for the above deviation of the focuses of the three beams has not been adapted in production of the typical electron guns 4 for a color picture tube 1, so that the above-described problem caused by the astigmatism has not been overcome.

FIG. 5 shows electron guns for a color picture tube in accordance with another embodiment of the prior art. The electron guns of FIG. 5 are so-called dynamic convergence electron guns which are free from the astigmatism caused by the nonuniform magnetic field of deflection yoke. In the electron guns 4, the focusing electrode unit 12 is divided into two focusing electrodes, that is, a first focusing electrode 12*d* and a second focusing electrode 12*f*. The side openings 12*b* and 12*c* of the first and second focusing electrodes 12*d* and 12*f* are opposed to each other at an inclination angle. In addition, the first focusing electrode 12*d* is applied with a constant voltage, while the second focusing electrode 12*f* is applied with a variable voltage 19 synchronous with a deflection signal.

FIG. 6 shows optical paths of the three electron beams of the electron guns 4 of FIG. 5. When the second focusing electrode 12*f* is applied with a voltage higher than the voltage applied to the first focusing electrode 12*d*, a pair of first electrostatic prisms 13 are formed between the first and second focusing electrodes 12*d* and 12*f* as shown in FIG. 6. With the first electrostatic prisms 13, the side beams 6R and 6B are diverged to the direction far from the center beam 6G. A pair of second electrostatic prisms 15 are formed in front of the second focusing electrode 12*f*. With the second electrostatic prisms 15, the side electron beams 6R and 6B, which side beams 6R and 6B were diverged to the direction far from the center beam 6G by the action of the first electrostatic prisms 13, are converged into the center beam 6G by the action of the static convergence between the second focusing electrode 12*f* and the accelerating electrode 14 while the beams 6R and 6B pass through the second electrostatic prisms 15. However, the side beams 6R and 6B, after passing through the first electrostatic prisms 13, still have a tendency to diverge to the direction far from the center beam 6G. Therefore, the three electron beams 6R, 6G and 6B are practically focused on a position H' longer than the desired position H, on which position H the three beams 6R, 6G and 6B will be focused when using only the second electrostatic prisms 15.

That is, the second focusing electrode 12*f* is applied with the voltage higher than a voltage applied to the first focusing electrode 12*d* when the electron beams 6R, 6G and 6B are deflected to the periphery of the screen 2 by the deflection yoke 5. The optical paths of the three electron beams 6R, 6G and 6B are thus lengthened, so that the electron guns are compensated for the deviation of the focuses of the three beams 6R, 6G and 6B from each other on the periphery of the screen 2.

Meanwhile, the second focusing electrode 12*f* is applied with the same voltage as that applied to the first focusing electrode 12*d* when the electron beams 6R, 6G and 6B are focused on the center of the screen 2. In this case, the focuses of the electron beams 6R, 6G and 6B coincide on the center of the screen 2 by the action of the static convergence of the electron guns 4.

Such control of position, on which position the focuses of the three electron beams 6R, 6G and 6B coincide, using the voltage synchronous with the deflection signal is called dynamic convergence of electron guns. The dynamic convergence carries out color control about the periphery of the screen 2.

As the second focusing electrode 12*f* is applied with the same voltage as that applied to the first focusing electrode 12*d* as described above, the ratio of the voltage of the second focusing electrode 12*f* to the voltage of the first focusing electrode 12*d* is increased. The focus strengths of the main electrostatic focusing lenses 17 are thus weakened, so that the three electron beams 6R, 6G and 6B are practically focused farther back of the center of the screen 2. When an appropriate voltage corresponding to the distance between the electron guns 4 and the screen 2 is applied to the second focusing electrode 12*f* synchronously with the deflection signal, the electron beams 6R, 6G and 6B will be precisely focused everywhere over the screen 2. Such focusing is called dynamic focusing.

When the focus strengths of the first electrostatic prisms 13 as well as the focus strengths of the main electrostatic lenses 17 are appropriately controlled, the focuses of the three electron beams 6R, 6G and 6B precisely coincide everywhere over the screen 2 and are precisely formed on the screen 2 without using nonuniform magnetic fields. Therefore, it is possible to provide uniform picture quality over the entire screen 2.

However, as the above electron guns use the deflection yoke generating the nonuniform magnetic field as described above, the electron beams of the electron guns are affected by severe astigmatism at about the periphery of the screen due to the nonuniform magnetic field of the deflection yoke. Therefore, the picture quality of the color picture tube is deteriorated due to distortion of the electron beams at about the periphery of the screen. Each side opening 12*b* or 12*c* of the second focusing electrode 12*f* continuously varies in its protuberance due to inclination of the electrode 12*f* as shown in FIG. 7 even though it is somewhat difficult to precisely distinguish between the differently protruded positions. Each side opening 12*b* or 12*c* of the second focusing electrode 12*f* thus has a most protruded portion 21, a nonprotruded portion 22 and slightly protruded portions 23. In addition, it is noted that the difference in height between the most protruded portion 21 and the nonprotruded portion 22, which portions 21 and 22 are commonly positioned on the X-axis 24 of the electrode 12*f*, as well as the difference of voltage between the second focusing electrode 12*f* and the first focusing electrode 12*d* has close connection with the dynamic convergence of the electron guns.

Meanwhile, the slightly protruded portions 23 are positioned on the Y-axis 25 of the electrode 12*f*, so that the portions 23 have no direct connection with the dynamic convergence in the X-axial direction. However, forming of asymmetric electric field in the X-axial direction 24 by both the most protruded portion 21 and the nonprotruded portion 22 is limited by the electric field formed in the Y-axis 25 by the slight protruded portions 23. Such a limit in forming of asymmetric electric field in the X-axial direction 24 weakens the focus strength of the electrostatic prism, thus allowing the astigmatism to affect the electron beams 6R, 6G and 6B.

In accordance with a test using the above compensation technique, the deviation of the focuses of the three beams 6R, 6G and 6B from each other on the screen 2 was reduced by 4 mm to 5 mm when the second focusing electrode 12*f* was applied with a voltage higher than that applied to the first focusing electrode 12*d* by about 1000 V. However, it is noted that the above compensation technique can not be profitably adapted for a color picture tube in view of that the most deviation of the focuses of three electron beams from each other on a screen of a 29" color picture tube using a uniform magnetic yoke is about 25 mm. Of course, the compensation effect will be improved when enlarging the difference of voltage between the first and second focusing electrodes 12*d* and 12*f*. However, this method can not be practically used due to difficulty in setting appropriate voltage difference and designing of circuit for precise forming of the focuses of the three electron beams on the screen. In this regard, the typical in-line electron guns for color picture tube can not help using a deflection yoke generating a strong nonuniform magnetic field, so that the typical electron guns can not overcome the astigmatism affecting the three electron beams at about the periphery of the screen.

SUMMARY OF THE INVENTION

It is, therefore, an object of the present invention to provide electron guns for color picture tube in which the above problems can be overcome and which strengthen the refracting action of electrostatic prisms, thus to need no nonuniform magnetic field or to need only a weak nonuniform magnetic field and to radically overcome possible distortion of three electron beams at about the periphery of a phosphor screen due to strong nonuniform magnetic field, and to improve the picture quality of the color picture tube.

In order to accomplish the above object, electron guns for color picture tube in accordance with an embodiment of the present invention comprises a plurality of cathodes having heaters, first and second plate grids, and variable asymmetric electrostatic lenses, which lenses include a focusing electrode unit having first and second focusing electrodes, a first electrostatic deflection burring electrode mounted to one end of the first focusing electrode, a second electrostatic deflection burring electrode mounted to one end of the second focusing electrode, and an accelerating electrode placed in front of the focusing electrode unit.

In another embodiment, the variable asymmetric electrostatic lenses include electrostatic deflection means placed between a first focusing electrode and a second focusing electrode, which electrostatic deflection means includes a first electrostatic deflection electrode electrically connected to the first focusing electrode and a second electrostatic deflection electrode electrically connected to the second focusing electrode.

BRIEF DESCRIPTION OF THE DRAWINGS

The above and other objects, features and other advantages of the present invention will be more clearly understood from the following detailed description taken in conjunction with the accompanying drawings, in which:

FIGS. 4A and 4B are views showing self-convergence magnetic fields of a deflection yoke of the electron guns of FIG. 2 respectively, in which:

FIG. 4A shows a horizontal pincushion magnetic field; and

FIG. 4B shows a vertical barrel magnetic field;

DESCRIPTION OF THE PREFERRED EMBODIMENTS

Figure 1:
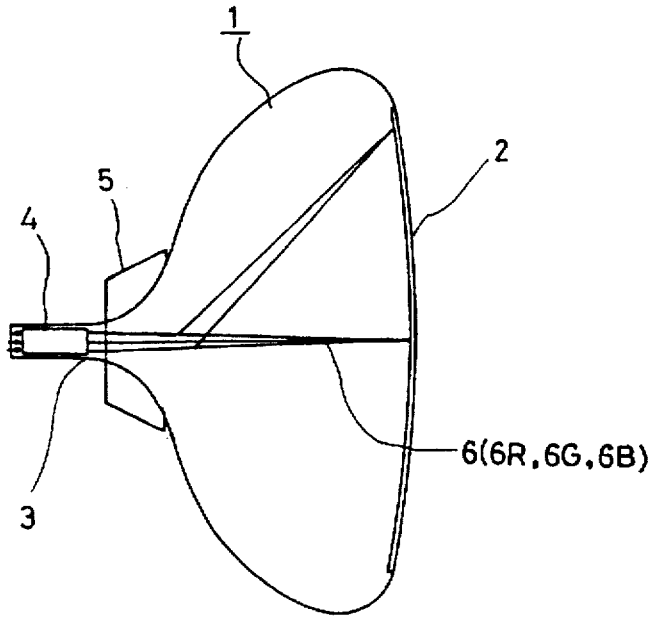
FIG.1 CONVENTIONAL ART
FIG. 1 is a schematic view of a typical in-line color picture tube.
Figure 2:
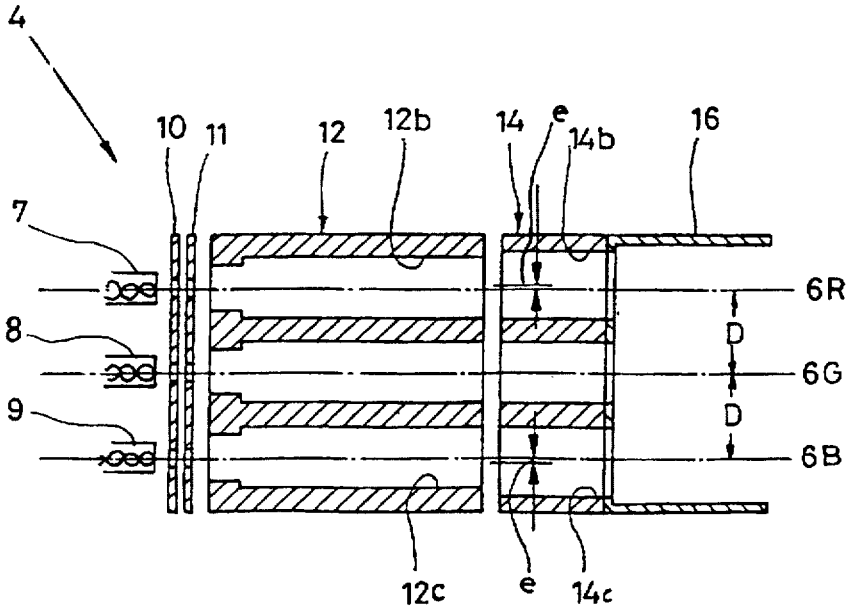
FIG.2 CONVENTIONAL ART
FIG. 2 is a sectional view showing a construction of typical in-line electron guns used in the in-line color picture tube of FIG. 1.
Figure 3:
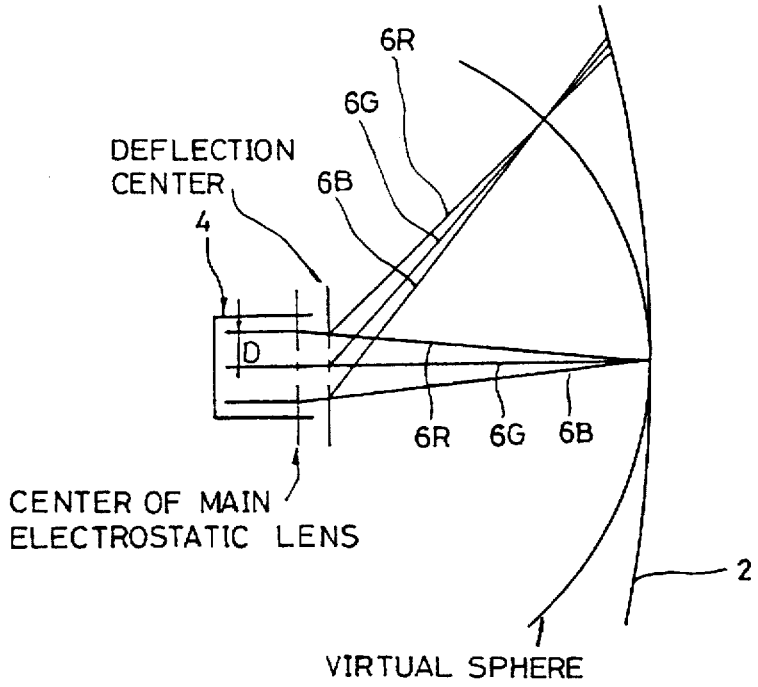
FIG.3 CONVENTIONAL ART
FIG. 3 is a schematic view showing focusing of three electron beams of the electron guns of FIG. 2 in accordance with distance variation.
Figure 4A:
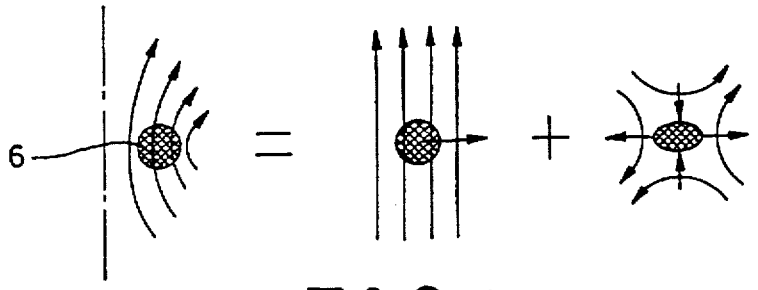
FIG.4A CONVENTIONAL ART
Figure 4B:
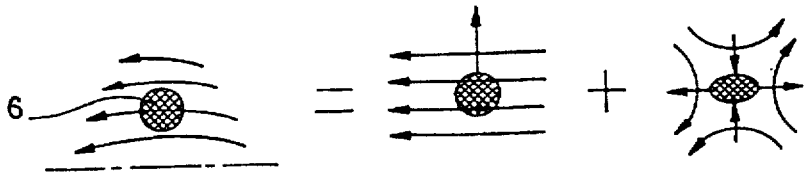
FIG.4B CONVENTIONAL ART
Figure 5:
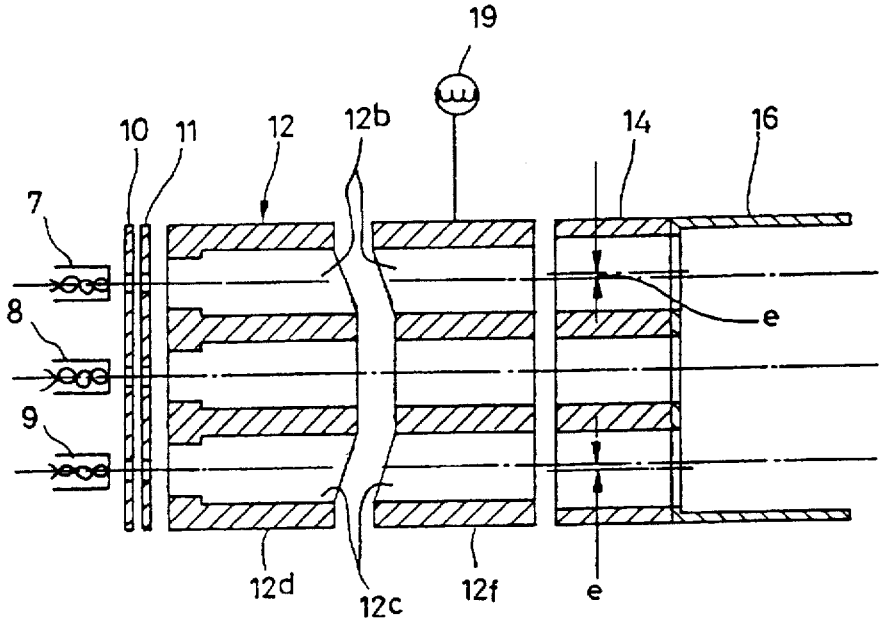
FIG.5 CONVENTIONAL ART
FIG. 5 is a sectional view showing a construction of typical dynamic convergence electron guns for preventing astigmatism caused by nonuniform magnetic field of a deflection yoke.
Figure 8:
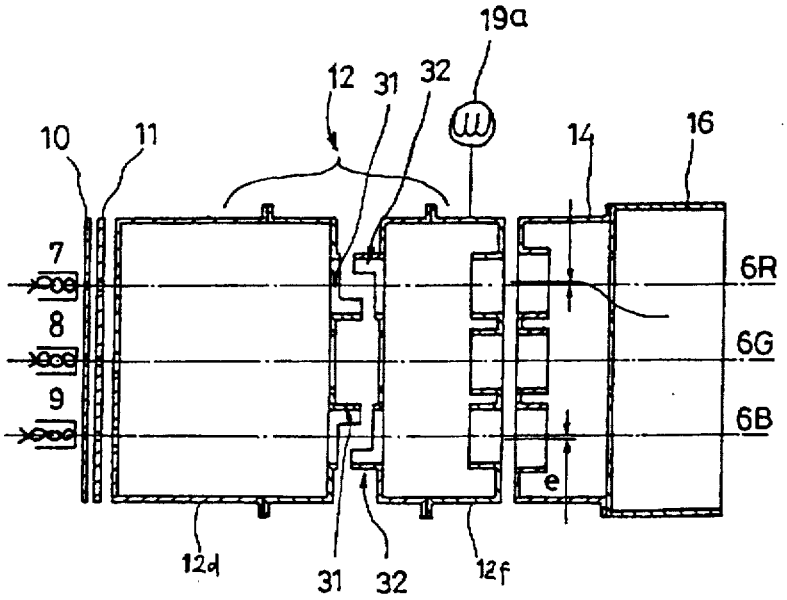
FIG. 8 is a sectional view showing a construction of in-line electron guns for an in-line color picture tube in accordance with a primary embodiment of the present invention.

With reference to FIG. 8, there is shown in-line electron guns for an in-line color picture tube in accordance with a primary embodiment of the present invention. As shown in this drawing, the electron guns of the primary embodiment include three electron beam sources or three cathodes 7, 8 and 9 that emit their respective electron beams or R, G and B beams 6R, 6G and 6B. The cathodes 7, 8 and 9 having their heaters are placed in the horizontal line and spaced out at regular intervals. The three axes of the cathodes 7, 8 and 9 are aligned with centers of their associated openings of two plate grids, that is, first and second parallel plate grids 10 and 11 in the similar manner to that described for the typical electron guns of FIG. 2.

The electron guns also include variable asymmetric electrostatic lenses comprising a focusing electrode unit 12. The focusing electrode unit 12 has two electrodes, that is, first and second focusing electrodes 12*d* and 12*f*, which electrodes 12*d* and 12*f* are orderly placed in front of the second grid 11. Opposed ends of the first and second focusing electrodes 12*d* and 12*f* are integrated with a first electrostatic deflection burring electrode 31 and with a second electrostatic deflection burring electrode 32 into single bodies respectively. Hereinbelow, the first electrostatic deflection burring electrode will be referred to the inside burring electrode, while the second electrostatic deflection burring electrode will be referred to the outside burring electrode. An accelerating electrode 14 is placed in front of the second focusing electrode 12*f* spaced apart from the electrode 12*f*. Placed in front of the accelerating electrode 14 is a hollow cylindrical shield cup 16.

Figure 9A:
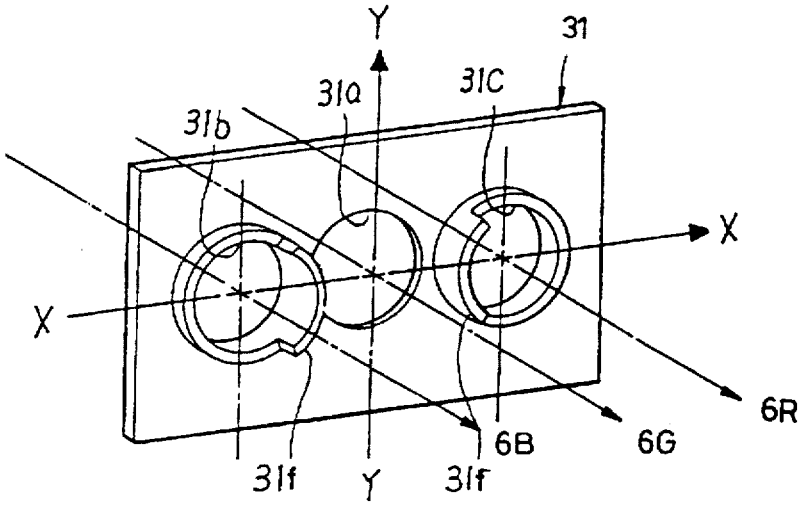
FIGS. 9A and 9B are perspective views respectively showing first and second deflection electrodes of electrostatic deflection means used in the electron guns of FIG. 8.
Figure 9B:
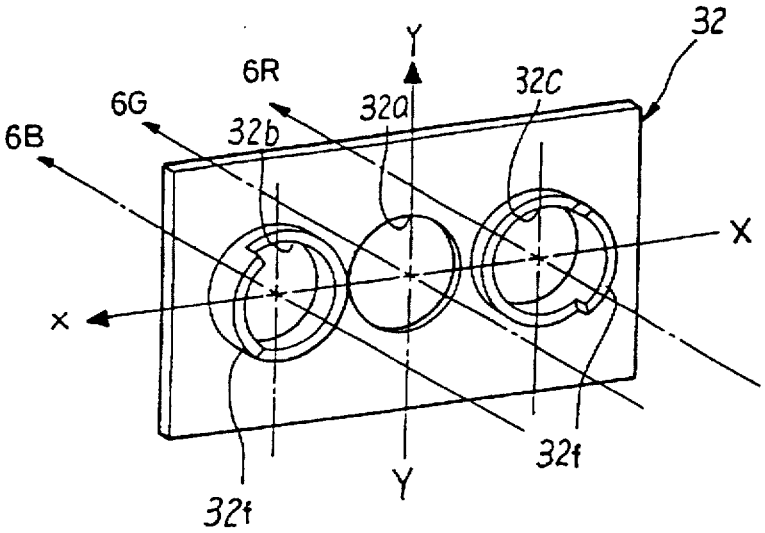

As shown in FIG. 9A, the inside burring electrode 31 has three electron beam passing openings 31*a*, 31*b* and 31*c*. The two side openings 31*b* and 31*c* of the three beam passing openings 31*a*, 31*b* and 31*c* have their burring portions 31*f* at their inside sections near to the center opening 31*a*, each of which burring portions 31*f* has a height higher than that of the other portion of each side opening 31*b* or 31*c*. In the same manner, the outside burring electrode 32 has three electron beam passing openings 32*a*, 32*b* and 32*c* as shown in FIG. 9B. The two side openings 32*b* and 32*c* of the three beam passing openings 32*a*, 32*b* and 32*c* have their burring portions 32*f* in their outside sections far from the center opening 32*a*, each of which burring portions 32*f* has a height higher than that of the other portion of each side opening 32*b* or 32*c*.

The inside and outside burring electrodes 31 and 32 are opposed to each other and spaced out at an interval, and electrically insulated from each other. In order to prevent weakening of focus strengths of electrostatic prisms due to magnetic field in the Y-axial direction, each burring portion 31*f* of the inside burring electrode 31 as well as each burring portion 32*f* of the outside burring electrode 32 is formed by partially cutting, for example, cutting a half of circumference of each side opening 31*b*, 31*c*, 32*b* and 32*c*.

Figure 10A:
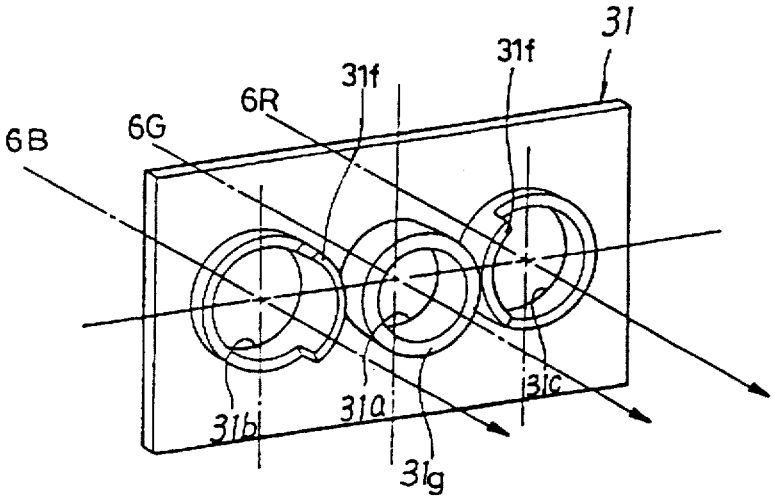
FIGS. 10A and 10B are perspective views respectively showing first and second deflection electrodes of electrostatic deflection means used in the electron guns of FIG. 8 in accordance with another embodiment of the invention.
Figure 10B:
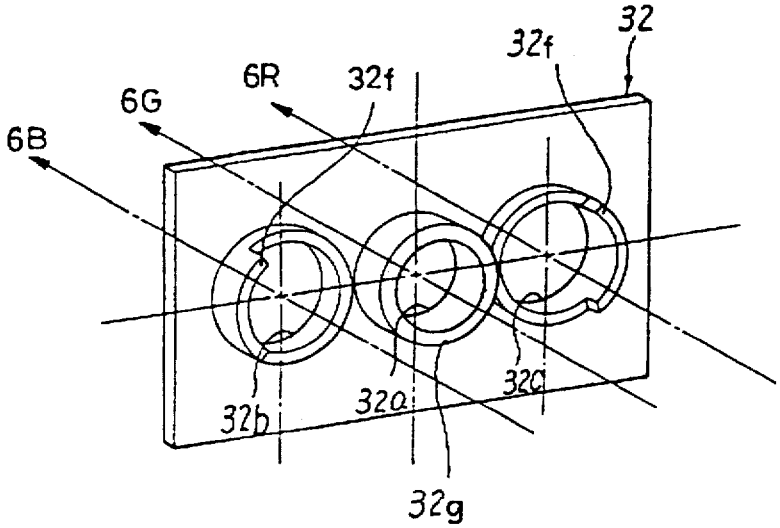

In accordance with another embodiment of the invention, the center beam passing openings 31*a* and 32*a* of the inside and outside burring electrodes 31 and 32 may be provided with hollow cylindrical burring portions 31*g* and 32*g* respectively as shown in FIGS. 10A and 10B. In this embodiment, the hollow cylindrical burring portions 31*g* and 32*g* of the center openings 31*a* and 32*a* are adapted for controlling the focus strengths of the center electron beam 6G and of the side electron beams 6R and 6B. Here, it should be understood that the height of the burring portion 31*g* or 32*g* of each center opening 31*a* or 32*a* may be freely set within a range suitable for controlling the focus strengths of the center electron beam 6G and of the side electron beams 6R and 6B. From the above description, it will be noted that those elements common to both the electron guns of the invention and the typical electron guns of FIG. 2 carry the same reference numerals.

In operation of the electron guns of the primary embodiment, the cathodes 7, 8 and 9 emit their electron beams 6R, 6G and 6B in accordance with the amount of heating of their heaters. The electron beams 6R, 6G and 6B from their cathodes orderly pass through the first and second grids 10 and 11. The electron beams 6R, 6G and 6B in turn pass through the beam passing openings 31*c*, 31*a* and 31*b* of the first focusing electrode 12*d* respectively and through the beam passing openings 32*c*, 32*a* and 32*b* of the second focusing electrode 12*f* respectively. At this time, the inside burring electrode 31 electrically connected to the first focusing electrode 12*d* is applied with a predetermined constant voltage, while the outside burring electrode 32 electrically connected to the second focusing electrode 12*f* is applied with a variable voltage 19*a* synchronous with a deflection signal. When the voltage applied to the outside burring electrode 32 is higher than that applied to the inside burring electrode 31, the side beams 6R and 6B respectively passing in the spaces between the burring portions 31*f* of the inside burring electrode 31 and their associated burring portions 32*f* of the outside burring electrode 32 are attracted to the outside burring electrode 32 applied with the higher voltage. However, as the side openings 31*b* and 31*c*, 32*b* and 32*c* of the inside and outside burring electrodes 31 and 32 have no burring portion in the Y-axial direction, the magnetic field is free from influence in the X-axial direction. In this regard, desired electrostatic prisms are readily formed in the X-axial direction even though there is a low difference of voltage between the inside and outside burring electrodes 31 and 32, thus to remove the astigmatism of the electron guns.

In the electron guns of the invention, the converged positions and the focuses of the three electron beams 6R, 6G and 6B are optionally set by controlling the voltage applied to the second focusing electrode 12*f*. Therefore, when the variable voltage 19*a* synchronous with the deflection signal is applied to the second focusing electrode 12*f*, the electron guns of the invention achieve the dynamic convergence as well as the dynamic focusing action, thus to improve the picture quality of the in-line color picture tube.

Figure 11:
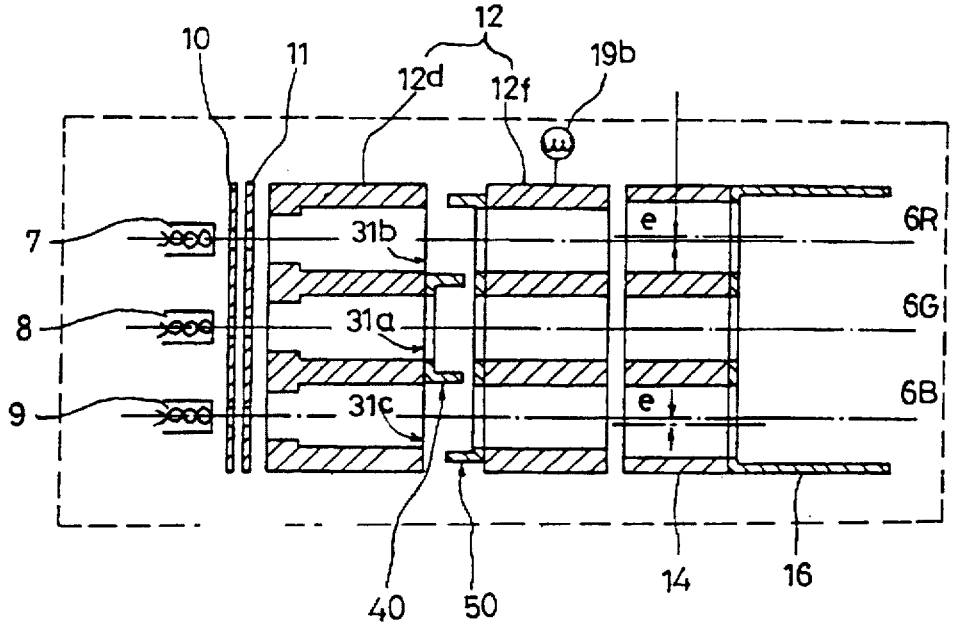
FIG. 11 is a sectional view showing a construction of in-line electron guns for an in-line color picture tube in accordance with a second embodiment of the present invention.

Turning to FIG. 11, there is shown a construction of in-line electron guns for an in-line color picture tube in accordance with a second embodiment of the present invention. In this second embodiment, the electron guns has variable asymmetric electrostatic lenses including electrostatic deflection means, which means is placed between a first focusing electrode 12*d* and a second focusing electrode 12*f*. As shown in this drawing, the electron guns of the second embodiment include three cathodes 7, 8 and 9 that have their heaters and emit their electron beams or R, G and B beams 6R, 6G and 6B. The three axes of the cathodes 7, 8 and 9 are aligned with centers of their associated openings of two plate grids, that is, first and second parallel plate grids 10 and 11 in the similar manner to that described for the primary embodiment. The electron guns also include the focusing electrode unit 12 including two electrodes, that is, the first and second focusing electrodes 12*d* and 12*f*, which electrodes 12*d* and 12*f* are orderly placed in front of the second grid 11. Opposed ends of the first and second focusing electrodes 12*d* 12*f* are electrically connected to a first electrostatic deflection electrode 40 and to a second electrostatic deflection electrode 50 respectively. In this second embodiment, the first and second electrostatic deflection electrodes 40 and 50 form the electrostatic deflection means.

Figure 12:
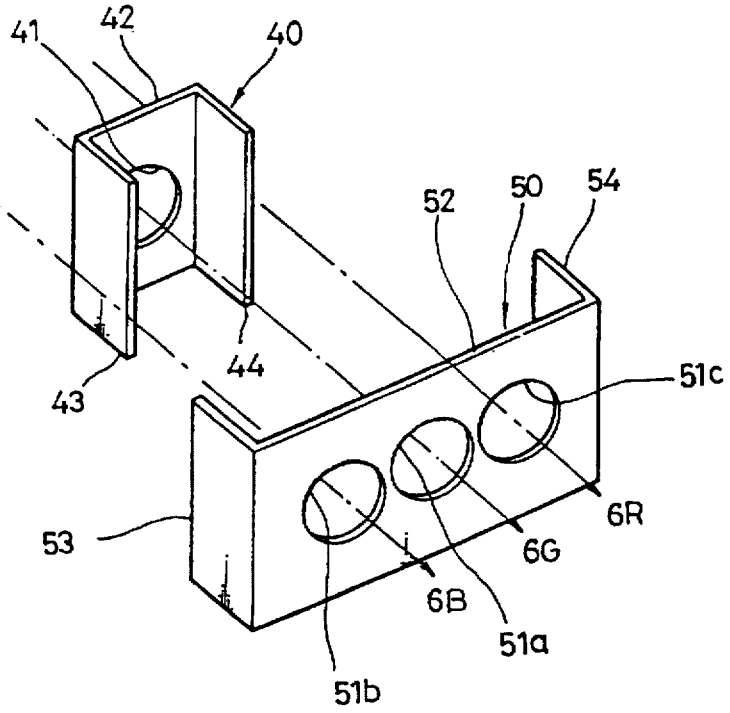
FIG. 12 is a perspective view showing first and second deflection electrodes of electrostatic deflection means used in the electron guns of FIG. 11.

As shown in FIG. 12, the first electrostatic deflection electrode 40 has a center beam passing opening 41 in the center of its body 42. Meanwhile, a pair of plates 43 and 44 integrally vertically extend from the opposed sides of the body 42 of the first deflection electrode 40 toward the second focusing electrode 12*f*.

The second electrostatic deflection electrode 50 has three electron beam passing openings 51*a*, 51*b* and 51*c* in its body 52, which openings 51*a*, 51*b* and 51*c* are spaced out at regular intervals. Meanwhile, a pair of plates 53 and 54 integrally vertically extend from the opposed sides of the body 52 of the second deflection electrode 50 toward the first focusing electrode 12*d*.

The first and second electrostatic deflection electrodes 40 and 50 are arranged such that the plates 43 and 44 of the first deflection electrode 40 are opposed to their associated plates 53 and 54 of the second deflection electrode 50. In this case, the first and second electrostatic deflection electrodes 40 and 50 are spaced out at an interval and electrically insulated from each other. In addition, the center of the center beam passing opening 41 of the first deflection electrode 40 as well as the center of the center beam passing opening 51*a* of the second deflection electrode 50 is aligned with the optical path of the center beam 6G. The plates 43 and 44 of the first deflection electrode 40 are placed between the center beam passing opening 41 of the body 42 and the optical paths of the side beams 6B and 6R respectively, so that the plates 43 and 44 do not disturb passing of the side beams 6B and 6R.

Figure 13:
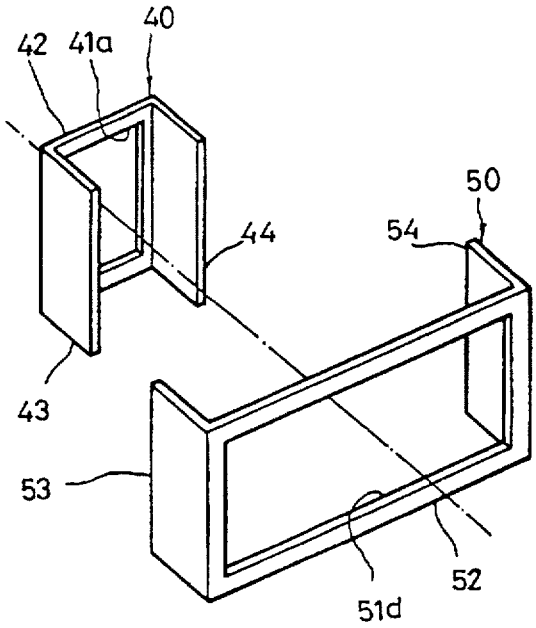
FIG. 13 is a perspective view showing first and second deflection electrodes of electrostatic deflection means used in the electron guns of FIG. 11 in accordance with another embodiment of the invention.

FIG. 13 shows electrostatic deflection means, that is, first and second electrostatic deflection electrodes, used in the electron guns of FIG. 11 in accordance with another embodiment of the invention. In this embodiment, the first electrostatic deflection electrode 40 has a rectangular opening 41*a* in its body 42. Meanwhile, a pair of plates 43 and 44 integrally vertically extend from the opposed sides of the body 42 of the first deflection electrode 40 toward the second deflection electrode 50. In the same manner, the second deflection electrode 50 has a rectangular opening 51*d* in its body 52. Meanwhile, a pair of plates 53 and 54 integrally vertically extend from the opposed sides of the body 52 of the second deflection electrode 50 toward the first deflection electrode 40. When forming the rectangular openings 41*a* and 51*d* of the first and second deflection electrodes 40 and 50, it is preferred to form the rectangular openings 41*a* and 51*d* as large as possible if the bodies 42 and 52 support their plates 43 and 44, 53 and 54.

Figure 14:
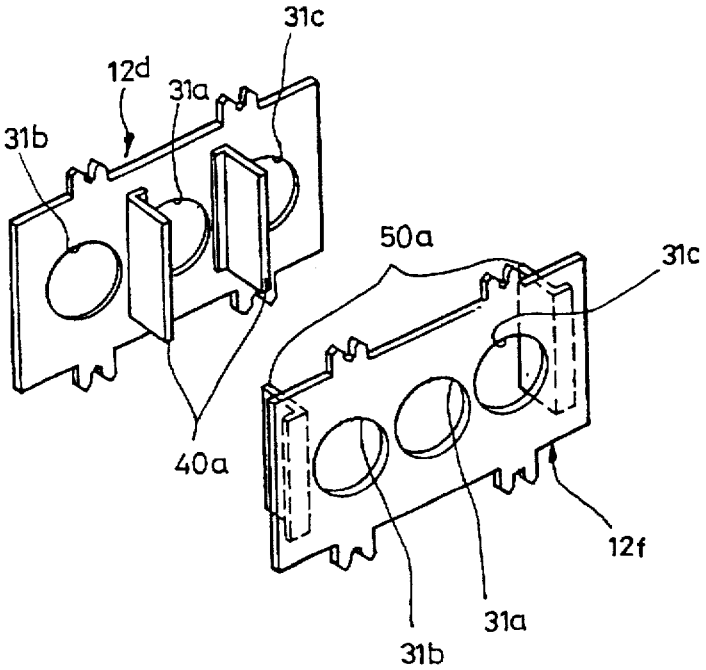
FIG. 14 is a perspective view showing electrostatic deflection means used in the electron guns of FIG. 11 in accordance with a further embodiment of the invention.

FIG. 14 is a perspective view showing electrostatic deflection means used in the electron guns of FIG. 11 in accordance with a further embodiment of the invention. In this embodiment, the electrostatic deflection means includes a plurality of, for example, two, first parallel plate electrodes 40*a*. The two plate electrodes 40*a* are vertically mounted to the first focusing electrode 12*d* at opposed sides of the center beam passing opening 31*a* of the electrode 12*d* and directed to the second focusing electrode 12*f*. The first focusing electrode 12*d* has two side beam passing openings 31*b* and 31*c* besides the center opening 31*a*. The electrostatic deflection means further includes a plurality of, for example, two, second parallel plate electrodes 50*a*. The plate electrodes 50*a* are vertically mounted to the second focusing electrode 12*f* at outside of the side beam passing openings 31*b* and 31*c* of the electrode 12*f* and directed to the first focusing electrode 12*d*. The second focusing electrode 12*f* has the center beam passing opening 31*a* besides the side openings 31*b* and 31*c*. In this embodiment, it is preferred to mount the first and second plate electrodes 40*a* and 50*a* to the first and second focusing electrodes 12*d* and 12*f* through welding respectively.

Figure 7:
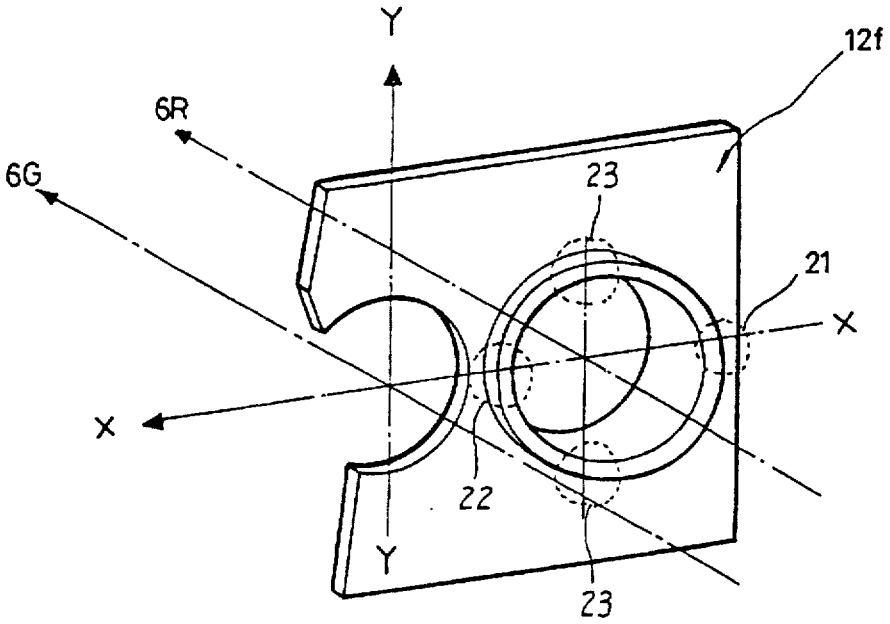
FIG.7 CONVENTIONAL ART
FIG. 7 is an enlarged perspective view of a second focusing electrode of the electron guns of FIG. 5.

In operation of the electron guns of the second embodiment, the cathodes 7, 8 and 9 emit their electron beams 6R, 6G and 6B in accordance with heating of their heaters. The electron beams 6R, 6G and 6B emitted from their cathodes 7, 8 and 9 pass orderly through the first and second grids 10 and 11. The electron beams 6R, 6G and 6B in turn pass through the beam passing openings of the first focusing electrode 12*d* respectively and through the beam passing openings of the second focusing electrode 12*f* respectively. At this time, the first electrostatic deflection electrode 40 electrically connected to the first focusing electrode 12*d* is applied with a predetermined constant voltage, while the second electrostatic deflection electrode 50 electrically connected to the second focusing electrode 12*f* is applied with a voltage higher than the voltage applied to the first electrode 40 by about 1000 V. When the voltage applied to the second electrostatic deflection electrode 50 is higher than that applied to the first electrostatic deflection electrode 40, the side beams 6R and 6B respectively passing in the spaces between the first deflection electrode 40 and the second deflection electrode 50 are attracted to the second deflection electrode 50 applied with the higher voltage. That is, the constant potential lines about the side openings 31*c* and 31*b* are asymmetric centering about the side beams 6R and 6B respectively, so that the side beams 6R and 6B are refracted. Otherwise stated, the side beams 6R and 6B are refracted to the center beam 6G by the action of static convergence of the electrostatic prisms as shown in FIG. 7.

Figure 6:
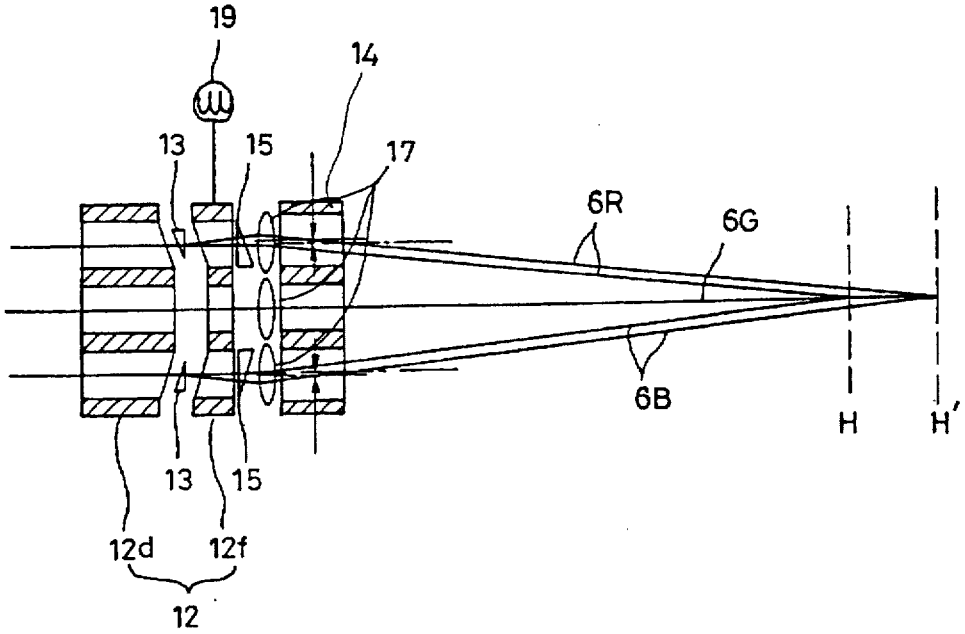
FIG.6 CONVENTIONAL ART
FIG. 6 is a schematic view showing optical passages of the electron beams of the electron guns of FIG. 5.

The refraction of the side beams 6R and 6B due to the first electrostatic prisms (see FIG. 6) has close connection with gradient of the constant potential lines as well as with potential difference. Therefore, the focuses of the electron beams 6R, 6G and 6B can be optionally controlled by controlling the voltage difference between the first electrostatic deflection electrode 40 and the second electrostatic deflection electrode 50.

In addition, the first and second electrostatic deflection electrodes 40 and 50 are electrically connected to the first and second focusing electrodes 12*d* and 12*f* as described above. In this regard, when the second focusing electrode 12*f* is applied with a variable voltage 19*b* synchronous with a deflection signal, the electron guns of the invention achieve the dynamic focusing action as well as the dynamic convergence of the first electrostatic prisms (not shown), thus to improve the picture quality of the in-line color picture tube.

As described above, electron guns for color picture tube in accordance with the invention strengthen refracting action of the electrostatic prisms owing to electrostatic deflection electrodes, thus to need no nonuniform magnetic field or to need only a weak nonuniform magnetic field. Therefore, the electron guns radically remove possible distortion of three electron beams at about the periphery of a phosphor screen of the color picture tube due to strong nonuniform magnetic field, thus to improve the picture quality of the color picture tube. In this regard, the electron guns of the invention can be preferably used in a color picture tube having a flat screen, which color picture tube has been noted to have a problem of deterioration of picture quality at about the periphery of the flat screen when using the typical nonuniform magnetic field system. The electron guns are also preferably used in a color picture tube having a longitudinal screen of the aspect ratio 16:9.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. In-line electron guns for a cathode ray tube comprising:

a uniform magnetic field deflection yoke which generates uniform magnetic fields for deflecting electron beams from a plurality of cathodes;

variable asymmetric electrostatic lenses having electrostatic deflection means, said electrostatic deflection means being placed between a first focussing electrode and a second focusing electrode, and said electrostatic deflection means including:

a first electrostatic deflection electrode electrically connected to said first focusing electrode, said first electrostatic deflection electrode having at least one beam passing opening formed in the center of a body of the first deflection electrode and having a pair of plates disposed adjacent to the opening, the plates extending toward said second focusing electrode; and a second electrostatic deflection electrode electrically connected to said second focusing electrode, said second electrostatic deflection electrode having one or three beam passing openings formed in a body of the second deflection electrode and spaced out at regular intervals and a pair of plates extending toward the first focusing electrode.

2. The electron guns of claim 1, wherein said first electrostatic deflection electrode includes:

a rectangular opening formed in the center of the body of the first deflection electrode; and the pair of plates extending from opposing sides of the body toward the second focusing electrode.

3. The electron guns of claim 1, wherein said second electrostatic deflection electrode includes:

a rectangular opening formed in the center of the body of the second deflection electrode; and the pair of plates extending from opposing sides of the body toward the first focusing electrode.

* * * * *